US006102320A

United States Patent [19]

Chen

[11] Patent Number: 6,102,320

[45] Date of Patent: Aug. 15, 2000

[54] FABRIC YARN SUPPLY APPARATUS WITH DUAL FEEDING FEATURES

[76] Inventor: Jen Hui Chen, No. 775 Chung Cheng Rd., Su-Lin City, Taipei County, Taiwan

[21] Appl. No.: 09/323,682

[22] Filed: Jun. 2, 1999

[51] Int. Cl.[7] ..... B65H 51/02

[52] U.S. Cl. ..... 242/365.6; 66/132 R

[58] Field of Search ..... 66/132 R, 132 T; 242/365.6, 157 R

[56] References Cited

U.S. PATENT DOCUMENTS

| | | | |
|---|---|---|---|
| 4,136,837 | 1/1979 | Feker et al. | 66/132 T X |
| 4,165,048 | 8/1979 | Paepke | 66/132 T X |
| 4,481,794 | 11/1984 | Sawazaki | 66/132 T |
| 4,483,159 | 11/1984 | Cucconi et al. | 66/132 T X |
| 4,489,899 | 12/1984 | Calamani et al. | 66/132 T X |
| 4,571,958 | 2/1986 | Dalmau Guell | 66/132 R X |
| 4,632,324 | 12/1986 | Gutschmit | 66/132 R X |
| 4,706,476 | 11/1987 | Memminger et al. | 66/132 R X |
| 5,388,747 | 2/1995 | Chen | 66/132 R X |
| 5,669,245 | 9/1997 | Shieh | 66/132 T |
| 5,802,879 | 9/1998 | Min | 66/132 T X |

*Primary Examiner*—Donald P. Walsh
*Assistant Examiner*—Collin A. Webb
*Attorney, Agent, or Firm*—Dougherty & Troxell

[57] ABSTRACT

A yarn supply apparatus with dual feeding features is disclosed. The apparatus is characterized in that a yarn guide arm is fabric yarnedly secured on the front top side of a support holder of the apparatus having an inner and an outer yarn eyes provided thereon in order to enable a short and a long fabric yarn knittings without a yarn brake detachment-and-mounting procedure.

6 Claims, 5 Drawing Sheets

FABRIC YARN SUPPLY APPARATUS WITH DUAL FEEDING FEATURES

BACKGROUND OF THE INVENTION

1. Field of the Invention

The present invention relates to a fabric yarn supply apparatus, and more particularly to a fabric yarn supply apparatus with dual feeding features, that is, one fabric yarn guide arm is for a long (i.e., low tension) fabric fabric yarn and for a short (i.e., high tension) fabric yarn.

2. Description of Prior Art

The trend of textile industry is the increasing need of a long fabric fabric yarn. The long fabric yarn is characterized in its low tension and fine texture. While a short fabric yarn is not able to be knitted as fabric with relatively large loop due to its high tension. Accordingly, manufacturer employs a technique, i.e., applies continuously a heated vapor to the short fabric yarn for processing the yarn before knitting, in order to lower the tension of the high tension yarn. Such a low tension yarn has a loop larger than the unprocessed one and as such it is required to trim the napping of the processed yarn. However, the processed yarn is able to knit a relatively high value added fabric. As an end, most manufacturers still prefer to process the long fabric yarn despite of the above additional processing. It is noted that the processed long fabric yarn has lost most of its tension. Further, an oxide with a lubricating grease (e.g., a greasy spot or powder) is formed on the surface of the processed long fabric yarn which made of many strands.

In FIG. 1, a prior art yarn supply apparatus is shown. The yarn path is described below. First, a yarn Y is led into a eye G1 of a yarn guide arm P and then through a yarn filtering gage E, a yarn brake B, an incoming yarn tension detecting arm D1, a lead-in yarn eye G2, a yarn supply drum F, a first pull-off eye G3, a second pull-off eye G4, and an outgoing fabric yarn tension detecting arm D2 to a circular knitting machine and needles (not shown). It is important to note that the yarn path from the eye G1 to the eye G2 is about vertical to the yarn path from the eye G2 to the yarn supply drum F. Further, the yarn Y is pressed between two components of the yarn brake B. Such prior art yarn supply apparatus is basically suitable to the short fabric yarn knitting due to its high tension and low operation speed (approximately five yards per second). However, as stated above, because the long fabric yarn is increasing its market share such an apparatus is unsatisfactory for the following reasons:

1. Operation speed is required to increase from about five yards per second to about one hundred yards per second. However, the oxide formed on the surface of the long fabric yarn is subject to be left on the elements of the apparatus which are contacted and especially on the components of the yarn brake B due to the contact area being the biggest among all contact areas. As a result, the smoothness of the yarn feed is disadvantageously affected because, for example, an adhesive substance left by the oxide of the long fabric yarn is formed between the components of the yarn brake B. This result greatly impedes the increase of operation speed and further lowers the quality of the fabric due to the uncontrollability of yarn tension. These are not desirable by the manufacturers.

2. The fabric yarn brake B is required for a short fabric yarn knitting. The components of the yarn brake B are further held together by means of a screw in some prior techniques for applying more force on the fabric yarn passed through therebetween. However, such technique is not required for the long fabric yarn knitting. As such, a detachment of the yarn brake B is required for the long fabric yarn knitting. Furthermore, it is required to mount the yarn brake B to the apparatus again for switching to the short fabric yarn knitting. Such a detachment-and-mounting switching procedure is really time-consuming and not cost effective. Moreover, it is troublesome to find a spare part immediately in the mounting procedure once a component of the yarn brake B was lost in the previous detachment procedure.

Thus, it is desirable to provide a yarn supply apparatus with dual feeding features to overcome the above drawbacks of prior art.

SUMMARY OF THE INVENTION

It is therefore an object of the present invention to provide a yarn supply apparatus with dual feeding features wherein the switching between a short and a long fabric yarn knittings is made simply by selecting a guiding of the fabric yarn through a first eye of a yarn guide arm and a guiding of the yarn through a second eye of the fabric yarn guide arm respectively, i.e., a first yarn path is through the first eye and a second yarn path is through the second eye without passing through a yarn brake. The present invention is capable of preserving the low tension and fine texture of the yarn, increasing the operation speed, and decreasing the cost as well as without a yarn brake detachment-and-mounting procedure.

The above and other objects, features and advantages of the present invention will become apparent from the following detailed description taken with the accompanying drawings.

DETAILED DESCRIPTION OF THE PREFERRED EMBODIMENTS

Figure 1:
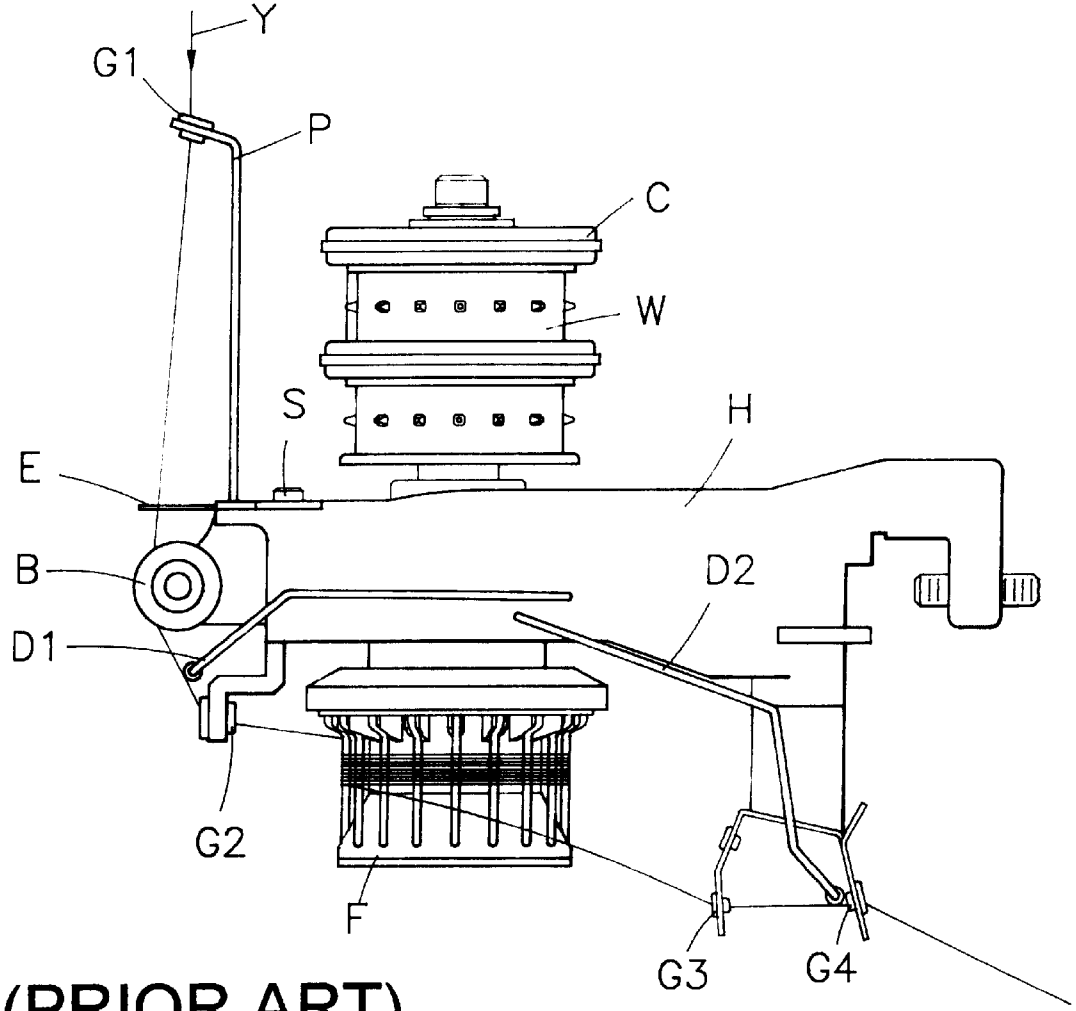
FIG. 1 (PRIOR ART)
FIG. 1 is a side view of a prior art yarn supply apparatus.
Figure 2:
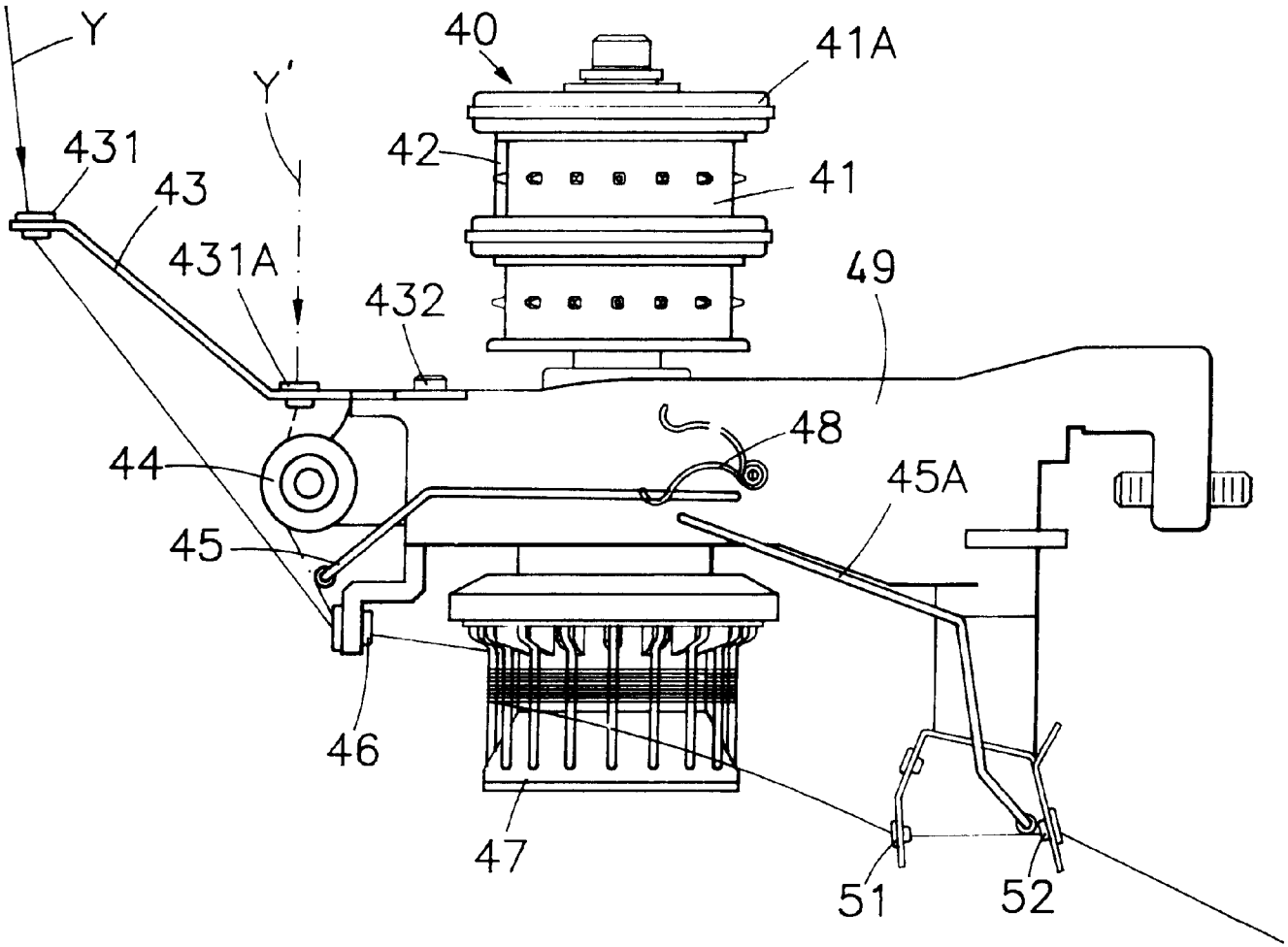
FIG. 2 is a side view of an embodiment of the present invention.
Figure 3:
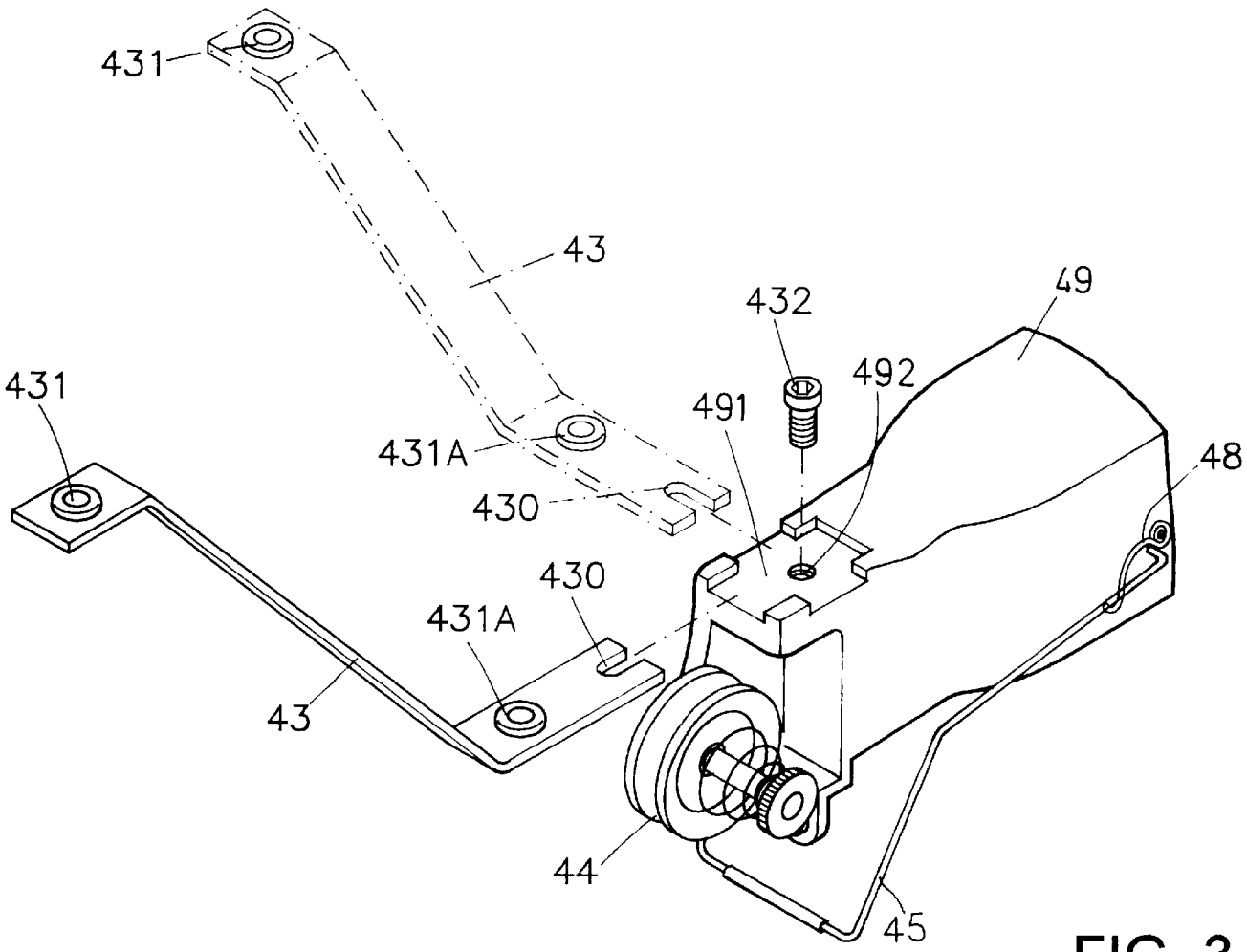
FIG. 3 is a partial perspective, broken apart view of FIG. 2.

Referring to FIGS. 2–3, there is shown a yarn supply apparatus in accordance with an embodiment of the present invention. The yarn supply apparatus 40 comprises a stop-motion device 41A, a pulley 41, a flat belt 42 for rotating the pulley 41, a yarn guide arm 43, a support holder 49, a yarn brake 44 located on a front side of the support holder 49, an incoming yarn tension detecting arm 45, an outgoing yarn tension detecting arm 45A, a lead-in yarn eye 46, a yarn supply drum 47, a limited rotatable element 48 for holding the incoming yarn tension detecting arm 45, a first pull-out eye 51, and a second pull-out eye 52.

The yarn guide arm 43 comprises a lower yarn eye (i.e., inner yarn eye) 431A, a recessed portion 430 on the surface of the lower yarn eye 431A, a higher yarn eye (i.e., outer yarn eye) 431, and a screw 432. The support holder 49 has a cross shaped recessed portion 491 provided on the top surface and a hole 492 provided on the center of the recessed portion 491.

The width of each of the intersected surfaces of the portion 491 corresponds to the width of the yarn guide arm 43. As such, it is possible of mounting the yarn guide arm 43 from the front, left, or right side of the support holder 49 for user selection. As to mounting, the screw 432 is placed through the recessed portion 430 to the hole 492 for holding the yarn guide arm 43 and the support holder 49 together.

As to a short fabric yarn knitting, the yarn path is from a yarn Y through the inner yarn eye 431A, the yarn brake 44, the tip portion of the incoming yarn tension detecting arm 45, the yarn eye 46, the yarn supply drum 47, the first pull-off eye 51, and the second pull-off eye 52 to a circular knitting machine and needles (not shown).

As to a long fabric yarn knitting, the yarn path is from a yarn Y' through the outer yarn eye 431, the yarn eye 46, the yarn supply drum 47, the first pull-off eye 51, and the second pull-off eye 52 to the circular knitting machine and needles (not shown).

It is noted that the control of whether the yarn Y' being in contact with the incoming yarn tension detecting arm 45 (i.e., the short fabric yarn knitting) or the yarn Y being not in contact with the yarn brake 44 and the incoming yarn tension detecting arm 45 (i.e., the long fabric yarn knitting) is by means of the down or the up movement of the limited rotatable element 48.

An inclined degree of the yarn guide arm 43, i.e., a height difference between the surface of the inner yarn eye 431 A and the surface of the outer yarn eye 431 is adjustable to be adapted to the direction of the incoming yarn (e.g., Y or Y') with respect to the yarn eye 46 in order to obtain a stable operation.

The design purpose, as characterized of the present invention, is to selectively guide the short and the long fabric yarn knittings, i.e., the yarn path of the latter is without the passing through of a yarn brake 44. As a result, the long fabric yarn knitting technique of the invention is capable of preserving the low tension and fine texture of the fabric yarn, increasing the operation speed, and without a yarn brake detachment-and-mounting procedure.

Figure 4:
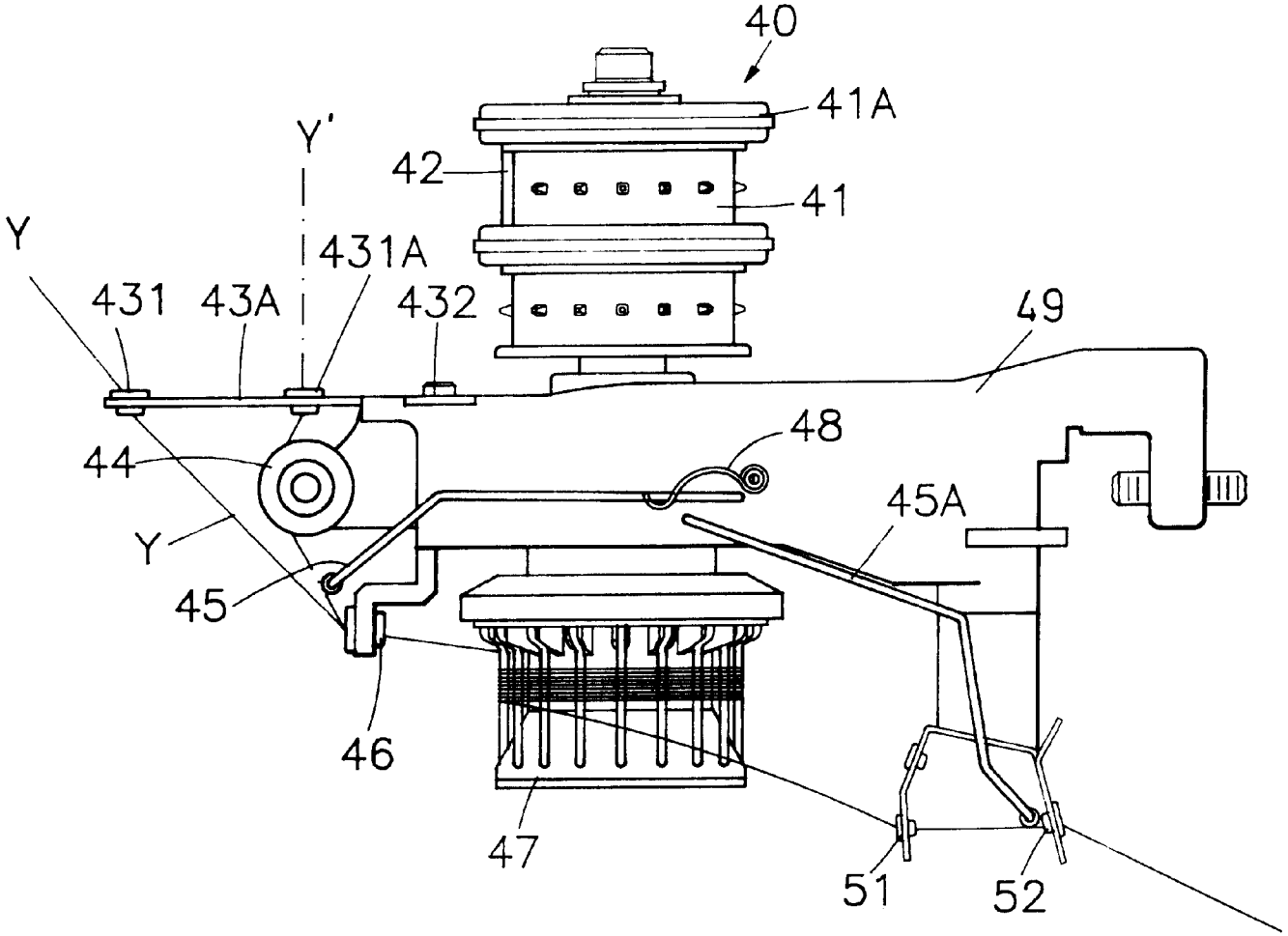
FIG. 4 is a side view of another embodiment of the present invention.
Figure 5:
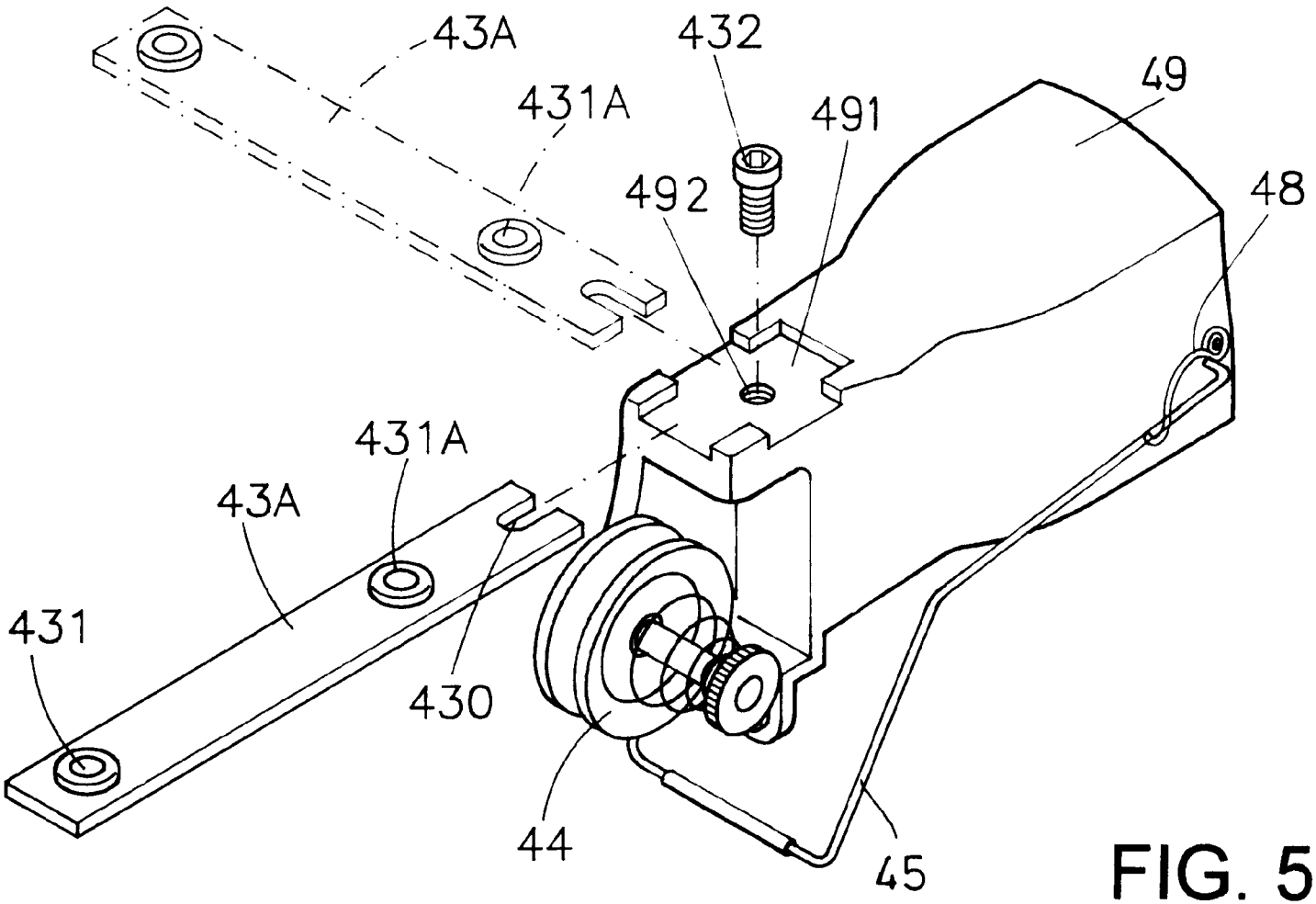
FIG. 5 is a partial perspective, broken apart view of FIG. 4.

Referring to FIGS. 4–5, there is shown a yarn supply apparatus in accordance with another embodiment of the present invention. The only difference between the configuration of the embodiment shown in FIGS. 2–3 and that of the embodiment shown in FIGS. 4–5 is that the yarn guide arm 43 of the former is a two-level structure with a connection part provided therebetween while a yarn guide arm 43A of the latter is a planar structure and extended horizontally outwardly. The detailed description of the embodiment shown in FIGS. 4–5 is omitted herein due to the functionality of each element thereof is identical to that of the embodiment shown in FIGS. 2–3.

While the invention herein disclosed has been described by means of specific embodiments, numerous modifications and variations could be made thereto by those skilled in the art without departing from the scope of the invention set forth in the claims.

What is claimed is:

1. A yarn guide device for guiding a long fabric yarn and a short fabric yarn for a yarn supply apparatus having a support holder, a pulley, a belt for rotating the pulley, a yarn supply drum located below the support holder and driven by the pulley, a yarn brake located on a first side of the support holder and a lead-in yarn eye located below the yarn brake, the yarn guide device comprising:

a) a yarn guide arm having a first yarn eye for guiding a short fabric yarn through the yarn guide arm, and a second yarn eye for guiding a long fabric yarn through the yarn guide arm, the second yarn eye spaced from the first yarn eye; and, b) a device for removably attaching the yarn guide arm to the support holder, such that the first yarn eye is adjacent to the yarn brake whereby short fabric yarn passing through the first yarn guide eye engages the yarn brake, and such that the second yarn eye is displaced from the yarn brake, whereby long fabric yarn passing through the second yarn guide eye does not engage the yarn brake.

2. The yarn guide device of claim 1 wherein the yarn guide arm is substantially planar in configuration.

3. The yarn guide device of claim 1 wherein the yarn guide arm has opposite end portions connected by a middle portion extending obliquely to the opposite end portions.

4. The yarn guide device of claim 3 wherein the first and second yarn guide eyes are each located in one of the opposite end portions.

5. The yarn guide device of claim 1 wherein the device for removably attaching the yarn guide arm to the support holder comprises:

a) a recessed portion in the support holder;

b) an opening formed in an end of the yarn guide arm adjacent to the first yarn guide eye; and, c) a threaded fastener extending through the opening and into the support holder whereby the end of the yarn guide arm is located in the recessed portions of the support holder.

6. The yarn guide device of claim 5 wherein the recessed portion in the support holder has a cruciform configuration.

* * * * *